US006404453B1

(12) United States Patent
Yoshikawa et al.

(10) Patent No.: US 6,404,453 B1
(45) Date of Patent: Jun. 11, 2002

(54) THERMAL PRINTHEAD AND CLIP PIN USED FOR THE SAME

(75) Inventors: Yasuhiro Yoshikawa; Shinobu Obata, both of Kyoto (JP)

(73) Assignee: Rohm Co. Ltd., Kyoto (JP)

( * ) Notice: Subject to any disclaimer, the term of this patent is extended or adjusted under 35 U.S.C. 154(b) by 0 days.

(21) Appl. No.: 09/680,318

(22) Filed: Oct. 6, 2000

(30) Foreign Application Priority Data

Oct. 13, 1999 (JP) ..... 11-290708

(51) Int. Cl.[7] ..... B41J 2/335

(52) U.S. Cl. ..... 347/200

(58) Field of Search ..... 347/200, 205, 347/208; 439/78, 382, 68; 371/791; 174/255, 261, 52.2; B41J 2/32; H01R 4/48

(56) References Cited

U.S. PATENT DOCUMENTS 4,470,648 A * 9/1984 Davis et al. ..... 439/68
5,167,513 A * 12/1992 Johnson et al. ..... 439/78
5,739,837 A * 4/1998 Nagahata et al. ..... 347/200
5,835,358 A * 11/1998 Brakus ..... 361/791
6,206,718 B1 * 3/2001 Takahashi et al. ..... 439/382

* cited by examiner

*Primary Examiner*—John Barlow
*Assistant Examiner*—K. Feggins
(74) *Attorney, Agent, or Firm*—Michael D. Bednarek; Shaw Pittman LLP

(57) ABSTRACT

A thermal printhead includes a primary substrate upon which a heating resistor, drive ICs, etc. are provided. The printhead also includes a secondary substrate for carrying e.g. a connector for a flexible cable. A plurality of clip pins are used for establishing electrical connection between the two substrates. Each clip pin is provided with a straight lead portion which is formed with a bend-facilitating part disposed between relatively rigid parts.

7 Claims, 8 Drawing Sheets

THERMAL PRINTHEAD AND CLIP PIN USED FOR THE SAME

BACKGROUND OF THE INVENTION

1. Field of the Invention

The present invention relates to a thermal printhead for performing printing by selectively heating up a plurality of heating dots. The invention also relates to a clip pin used for a thermal printhead.

2. Description of the Related Art

As is known in the art, thermal printhead are designed to selectively supply heat energy to thermosensitive paper or transfer ink ribbon for performing printing. FIG. 13 of the accompanying drawings shows the principal components of a conventional thermal printhead. As illustrated, this conventional printhead includes an insulating primary substrate 1', a secondary substrate 2', and a plurality of clip pins 3' for establishing electrical connection between the primary and the secondary substrates.

The primary substrate 1' supports drive ICs 6' covered by a protection coat 7'. The drive ICs 6' control the operation of a heating resistor 5' formed on the upper surface of the substrate 1'. The heating resistor 5' is divided into a multiplicity of small portions or "heating dots" which are selectively heated up by the drive ICs 6' in accordance with given print data.

In the conventional printhead, a plurality of terminals 8', connected to e.g. the drive ICs 6', are provided along the right edge of the substrate 1'. Each of the terminals 8' is held in contact with the clip portion 3*b*' of a relevant one of the clip pins 3'. The lead portion 3*a*' of each clip pin 3' extends horizontally from the clip portion 3*b*' to be connected to one of the terminal pads 9' formed on the upper surface of the secondary substrate 2'. The terminal pads 9' are connected via a wiring pattern (not shown) to a connector 10' attached to the lower surface of the secondary substrate 2'. In operation, a data transmission cable (not shown), which may be connected to a host computer, is plugged into the connector 10' for supplying the drive ICs 6' with signals, data etc. required for performing printing.

The conventional printhead has been found disadvantageous in the following points.

Referring to FIG. 14 of the accompanying drawings, the lead portion 3*a*' of each clip pin 3' has a uniform thickness over the entire length thereof. Thus, each clip pin 3' is rendered rather rigid, so that it will not be bent even when an external force is exerted on the lead portion 3*a*' (see the arrows A in FIG. 13). The exertion of such external force may occur when the user of the printhead tries to plug a flexible cable into the connector 10'.

Upon application of such external force on the lead portion 3*a*', the clip portion 3*b*' of the clip pin 3' may be unduly dislocated on the terminal 8', thereby causing the so-called called "loose contact" in relation to the terminal 8'. In an extreme case, the clip portion 3*b*' may even be wrenched off the edge of the primary substrate 1'.

SUMMARY OF THE INVENTION

The present invention has been proposed under the circumstances described above, and an object of the present invention is to provide a clip pin capable of overcoming the above problems. Another object of the present invention is to provide a thermal printhead using such clip pins.

According to a first aspect of the present invention, there is provided a thermal printhead which includes: a first substrate provided with a heating resistor; a second substrate spaced from the first substrate; and a plurality of connectors bridging between the first and the second substrates. Each connector is formed with an elongated lead portion which is provided with a bend-facilitating part and a relatively rigid part.

According to a preferred embodiment of the present invention, the bend-facilitating part is smaller in thickness than the rigid part.

Preferably, the bend-facilitating part may be greater in width than the rigid part. Further, the bend-facilitating part may be generally equal in cross-sectional area to the rigid part.

The bend-facilitating parts of the respective connectors may be arranged in a single line. More preferably, the bend-facilitating parts may be arranged in at least two lines. In either case, all of the bend-facilitating parts may be disposed between the first and the second substrates.

Preferably, each connector may be provided with a clip portion formed integral with the lead portion.

According to a second aspect of the present invention, there is provided a clip pin for connecting separate electrical units. The clip pin includes: a generally straight lead portion; and a clip portion formed at an end of the lead portion. The lead portion is provided with a bend-facilitating part which is smaller in thickness than a remaining part of the lead portion.

Preferably, the clip portion may include an upper holding part and a lower holding part spaced vertically from the upper holding part. Further, the bend-facilitating part may have a principal surface whose normal extends generally vertically.

Other features and advantages of the present invention will become apparent from the detailed description given below with reference to the accompanying drawings.

DETAILED DESCRIPTION OF THE PREFERRED EMBODIMENTS

The preferred embodiments of the present invention will be described below with reference to the accompanying drawings.

Figure 1:
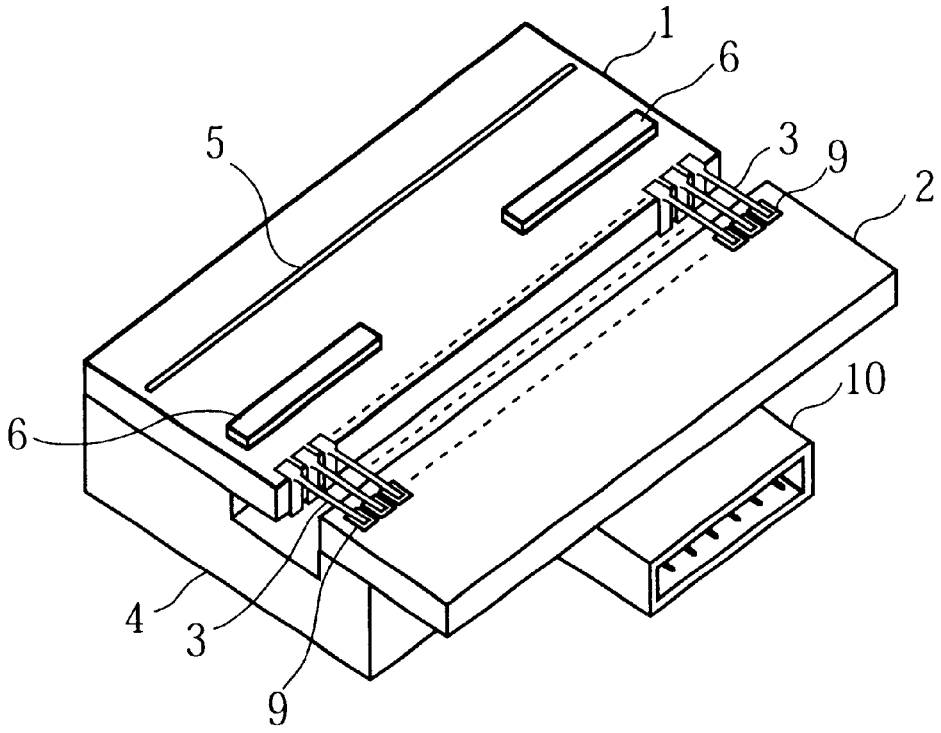
FIG. 1 is a perspective view showing a thermal printhead embodying the present invention.
Figure 2:
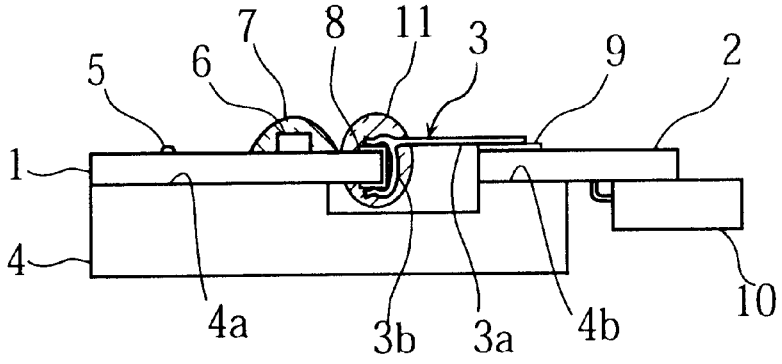
FIG. 2 is a side view showing the printhead of FIG. 1.

Reference is first made to FIGS. 1 and 2 showing a thermal printhead according to the present invention. Basically, the illustrated thermal printhead includes an insulating primary substrate 1, an insulating secondary substrate 2, a plurality of electrically conductive clip pins 3 and a thermally conductive heat sink 4.

The primary substrate 1, which may be made of e.g. alumina ceramic, has a generally rectangular configuration. An elongated heating resistor 5 is formed on the upper surface of the substrate 1. As shown in FIG. 1, the heating resistor 5 extends longitudinally of the substrate 1. Though not illustrated, the heating resistor 5 is divided into a predetermined number of heating dots.

The primary substrate 1 also carries a plurality of drive ICs 6 for controlling the operation of the heating resistor 5. A wiring pattern (not shown) is formed on the substrate 1 for connecting e.g. the heating resistor 5 to the drive ICs 6. In operation, the heating dots of the heating resistor 5 will be selectively heated up under the control of the drive ICs 6, thereby supplying heat energy to thermosensitive paper or transfer ink ribbon for performing required printing. As shown in FIG. 2, the drive ICs 6 are enclosed by a protection coating 7 formed on the upper surface of the substrate 1.

Further, the primary substrate 1 is provided with a plurality of terminals 8 arranged along an longitudinal edge thereof. Each terminal 8 is connected to a relevant one of the clip pins 3. As shown in FIG. 2, the terminal 8 and the clipping part of the clip pin 3 are enclosed by a resin material 11 for facilitating the holding of the clip pin 3 onto the edge of the primary substrate 1.

The secondary substrate 2, which may be made of e.g glass-fiber-reinforced epoxy resin, has also a generally rectangular configuration. As shown in FIG. 1, the length of the secondary substrate 2 is substantially equal to that of the primary substrate 1. On the other hand, as shown in FIG. 2, the width of the substrate 2 is smaller than that of the substrate 1.

As shown in FIG. 1, a plurality of terminal pads 9 are arranged along a longitudinal edge of the substrate 2. Each pad 9 is connected to a relevant one of the clip pins 3. Adjacent to the other longitudinal edge of the substrate 2 is provided a connector 10 which is connected to the lower surface of the substrate 2. In operation, the connector 10 is coupled to a flexible cable which in turn is connected to an external device such as a host computer.

The heat sink 4 is formed with a straight groove extending over the entire length of the heat sink. This groove divides the upper surface of the heat sink 4 into a first portion 4*a* and a second portion 4*b*, as shown in FIG. 2. The first portion 4*a* is attached to the primary substrate 1, while the second portion 4*b* is attached to the secondary substrate 2. For securing the attachment, adhesives such as glue or double-sided tape may be used.

With the above-described arrangements, various kinds of signals (including data, commands, instructions, etc.) transmitted from the external device will be supplied to the drive ICs 6 via the connector 10, the wiring pattern on the substrate 2, the clip pins 3 and the wiring pattern on the substrate 1. Upon receiving these signals, the drive ICs 6 cause the heating dots of the heating resistor 5 to be selectively heated up for generating required images on recording medium (e.g. thermosensitive paper).

In the illustrated preferred embodiment, the primary substrate 1 should be accurately positioned relative to the secondary substrate 2, so that the respective terminals 8 are properly connected to the relevant pads 9 via the clip pins 3. Such positioning may be attained in the following manner.

Figure 3:
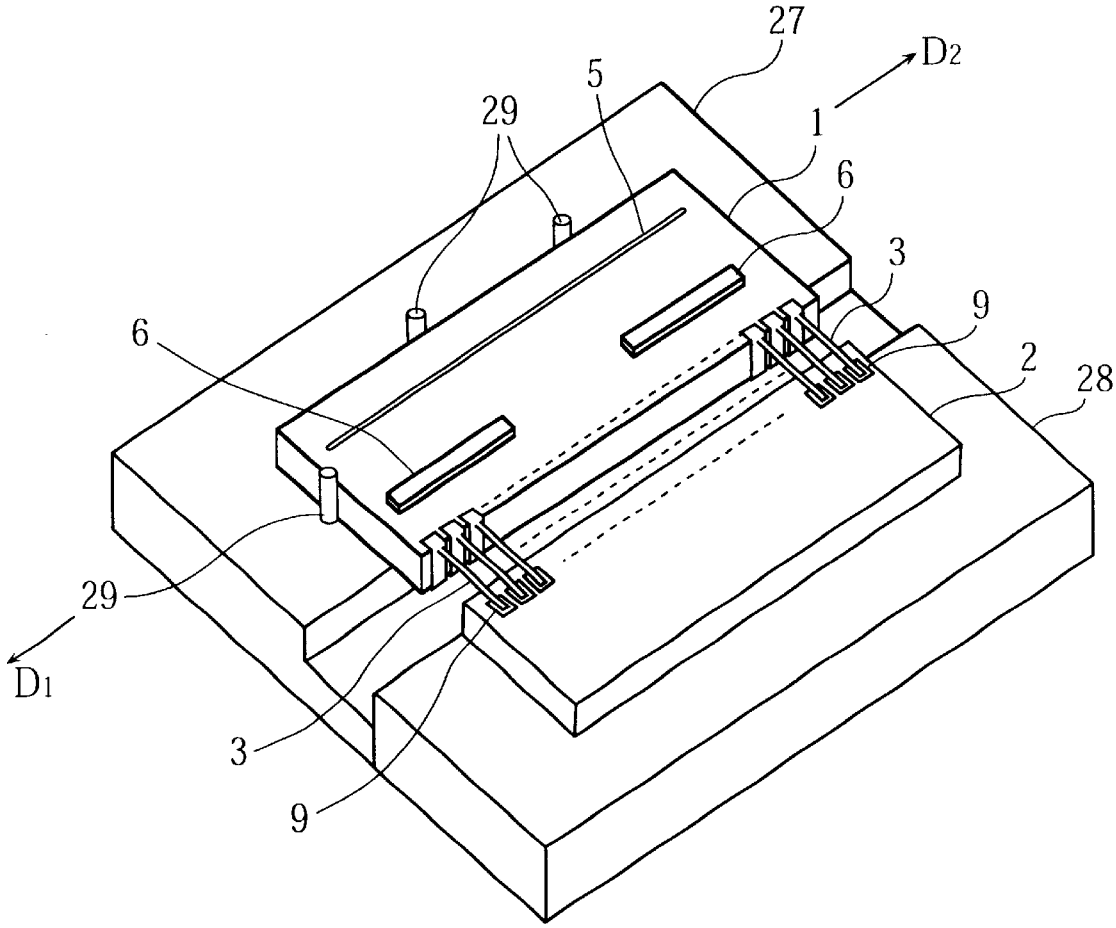
FIG. 3 is a perspective view illustrating a step for fabricating the printhead of FIG. 1.

Referring to FIG. 3, use may be made of a positioning device provided with first and second chuck members 27, 28. These two chuck members are held in sliding contact with each other, and the first chuck member 27 is movable in the opposite directions D1 and D2. As shown, the primary substrate 1 (provided beforehand with the hating resistor 5, the drive ICs 6, etc.) is mounted onto the first chuck member 27, while the secondary substrate 2 (provided beforehand with the pads 9, non-illustrated wiring pattern, etc.) is mounted onto the second chuck member 28. The respective clip pins 3 have been fixed beforehand to the primary substrate 1. In the illustrated example, the first chuck member 27 is provided with several upright pins 29 for positioning the primary substrate 1. Though not illustrated, the second chuck member 28 may also be provided with positioning means as in the first chuck member 27.

Then, the first chuck member 27 will be moved in the direction D1 or direction D2 to align the tips of the clip pins 3 with the relevant pads 9. When this alignment is attained, the first chuck member 27 is stopped. Then, the respective clip pins 3 will be soldered to the pads 9.

After the wiring pattern on the primary substrate 1 is properly connected to the wiring pattern on the secondary substrate 2 via the clip pins 3, the substrates 1 and 2 are removed from the positioning device. Then, the heat sink 4 (see FIGS. 1 and 2) is attached to the lower surfaces of the respective substrates 1, 2. Finally, the connector 10 is attached to the lower surface of the secondary substrate 2.

Figure 4:
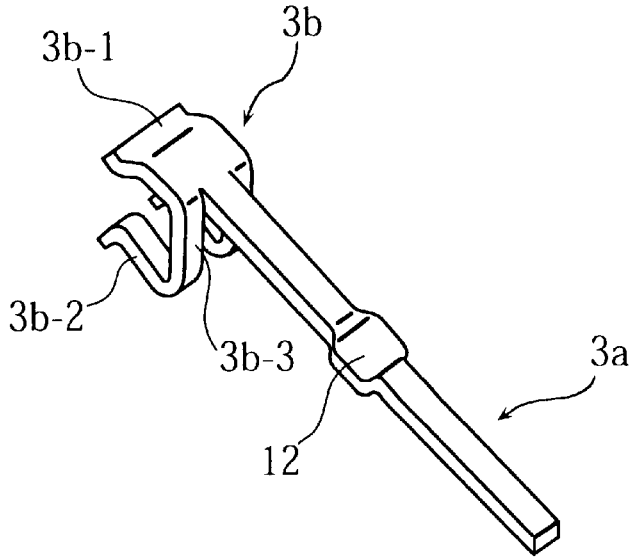
FIG. 4 is a perspective view showing a clip pin used for the printhead of FIG. 1.

Reference is now made to FIGS. 4 and 5 showing the details of the clip pins 3.

As shown in FIG. 4, the clip pin 3, which may be made of phosphor bronze, includes a generally straight lead portion 3*a* and a clip portion 3*b* formed at one end of the lead portion 3*a*. The clip portion 3*b* has a generally C-shaped cross section suitable for clipping onto the edge of the primary substrate 1.

Specifically, the clip portion 3*b* is provided with an upper holding part 3*b*-1, two lower holding parts 3*b*-2, and two generally upright intermediate parts 3*b*-3 connecting the upper holding part 3*b*-1 to the lower holding parts 3*b*-2. The upper holding part 3*b*-1 is spaced generally vertically from the lower holding parts 3*b*-2.

Figure 5A:
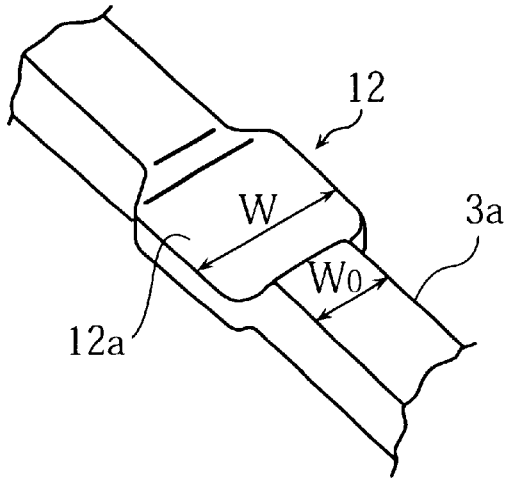
FIG. 5A is an enlarged perspective view showing the principal portion of the clip pin of FIG. 4.
Figure 5B:
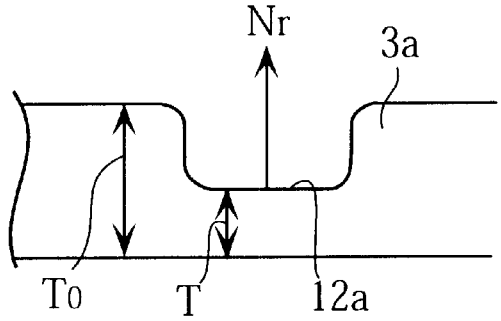
FIG. 5B is a side view showing the principal portion of the clip pin shown in FIG. 5A.

According to the present invention, the lead portion 3*a* is provided with a bend-facilitating part 12 which is spaced from the clip portion 3*b* by a predetermined distance, as shown in FIG. 4. The bend-facilitating part 12 has a principal surface 12*a*, as shown in FIG. 5A, which has a relatively large width W. The thickness T of the bend-facilitating part 12 is rendered smaller than the thickness To of the remaining part (or rigid part) of the lead portion 3*a*, as shown in FIG. 5B. The normal Nr of the principal surface 12*a* extends in the same direction as that in which the upper and the lower holding pieces 3*b*-1, 3*b*-2 are spaced from each other.

With such an arrangement, when a vertical external force is exerted on the lead portion 3*a* with the clip portion 3*b* fixed in position, the lead portion 3*a* will be bent vertically at the relatively thin part 12. Thus, the conventional problem of dislocating the clip portion 3*b* is overcome in the thermal printhead of the present invention.

Further, as shown in FIG. 5A, the bend-facilitating part 12 has the width W which is greater than the width W0 of the rigid part of the lead portion 3*a*. This arrangement makes it possible to equalize the cross-sectional area of the bend-facilitating part 12 to that of the rigid part of the lead portion 3*a*. Thus, a sufficiently large amount of current is allowed to pass through the lead portion 3*a*.

Figure 6:
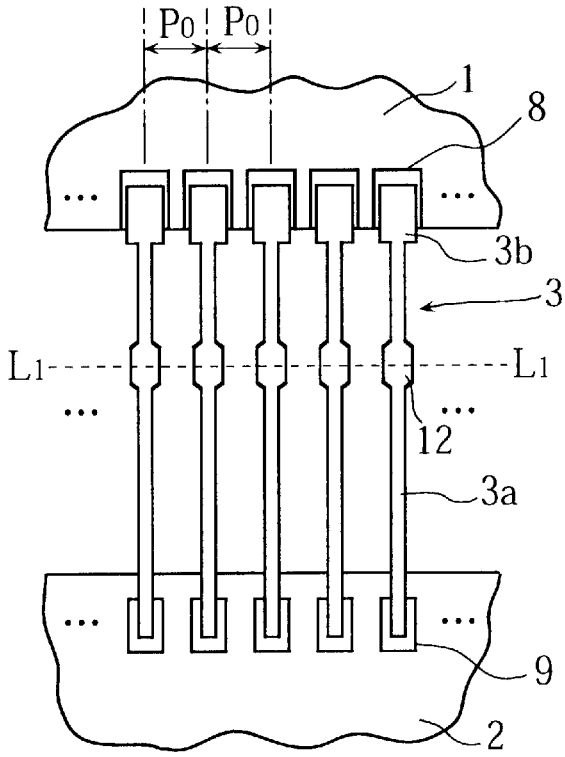
FIG. 6 is a plan view showing an arrangement of clip pins bridging between two substrates.
Figure 7:
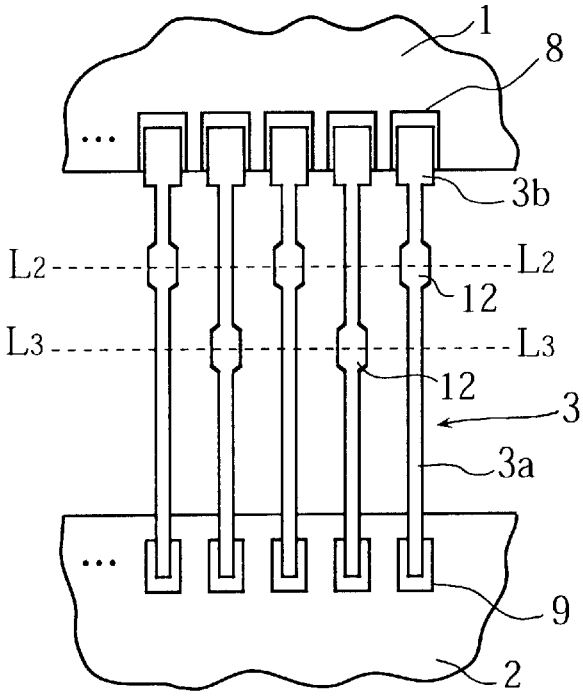
FIG. 7 is a plan view showing a different arrangement of clip pins.

According to the present invention, the bend-facilitating parts 12 of the respective pins 3 may be arranged in a single line L1—L1 disposed between the primary and the secondary substrates 1 and 2, as shown in FIG. 6. Instead, the bend-facilitating parts 12 may be staggered. More accurately, as shown in FIG. 7, some of the bend-facilitating parts 12 are arranged in a line L2—L2, while the other parts 12 are arranged in a different line L3—L3. In this manner, the short-circuiting between the adjacent bend-facilitating parts 12 are reliably prevented.

In the illustrated preferred embodiment, the bend-facilitating part 12 is a horizontally flattened portion (see FIGS. 4 and 5A). However, the present invention is not limited to this. For instance, the bend-facilitating part 12 may be vertically flattened, thereby allowing the lead portion 3*a* to be bent horizontally.

Figure 8:
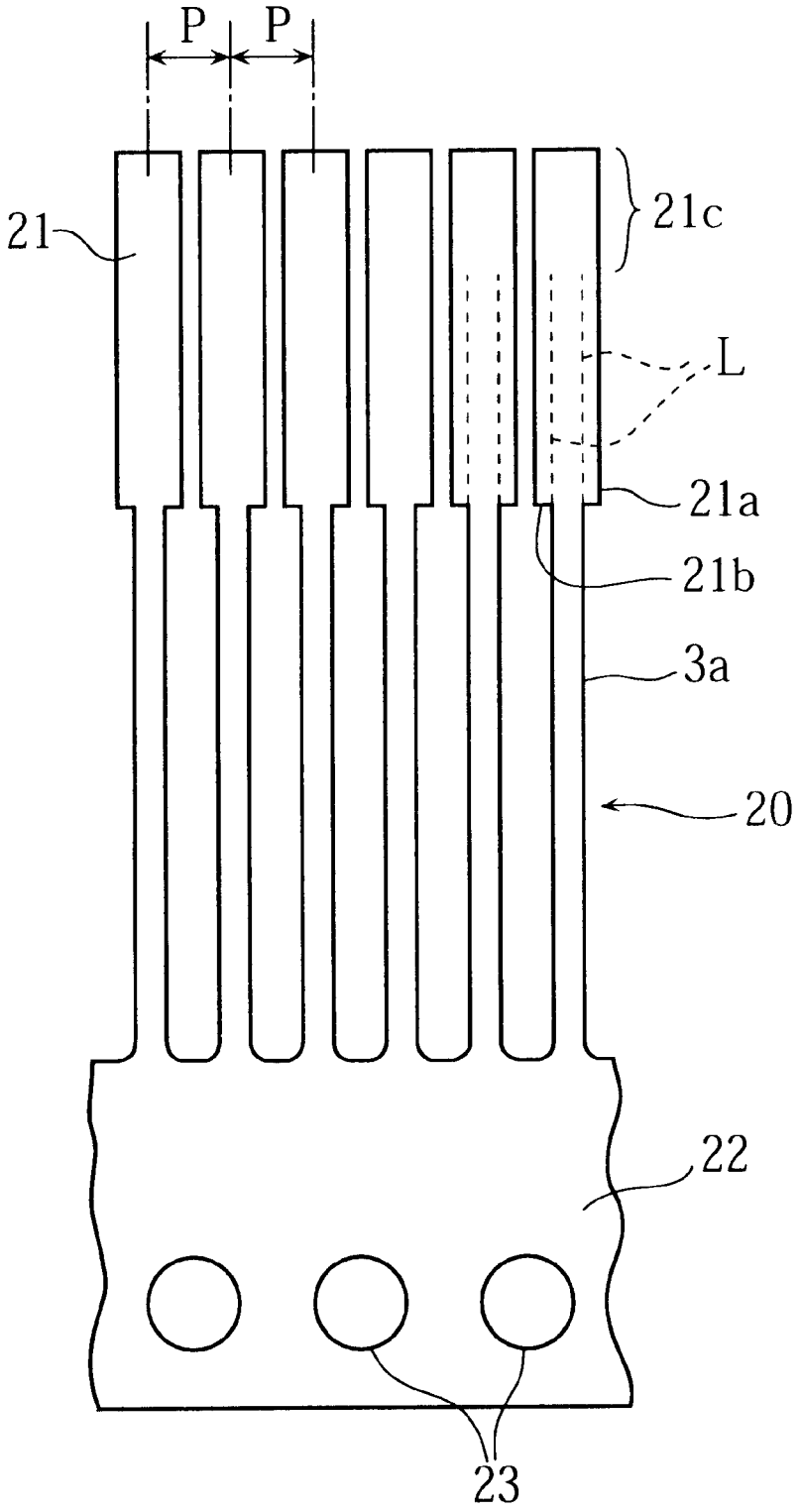
FIGS. 8–10 illustrate a method of making the clip pins.

The plurality of clip pins 3 may be made collectively in the following manner. First, a sufficiently large, rectangular plate made of phosphor bronze is prepared. Then, by punching this phosphor bronze plate, a predetermined pattern as shown in FIG. 8 is obtained. As illustrated, this pattern includes a plurality of intermediates 20 which are prototypes for the clip pins 3. Each of the intermediates 20 is provided at one end thereof with an enlarged, rectangular head portion 21. The other ends of the respective intermediates 20 are connected to a tie bar 22 which is formed with a plurality of holes 23. When subjected to required processing, the intermediates 20 are fixed in position by the holes 23. The intermediates 20 connected to the common tie bar 22 are arranged at a constant pitch P which is equal to the pitch P0 (see FIG. 6) of the terminals 8 on the substrate 1. With such an arrangement, it is possible to connect the resulting clip pins 3 to the relevant terminals 8 while the clip pins 3 are still attached to the tie bar 22. In this manner, the production time of a thermal printhead can be reduced than when the clip pins 3 are first cut off the tie bar 22 and then connected to the relevant terminals 8, one by one.

Figure 9A:
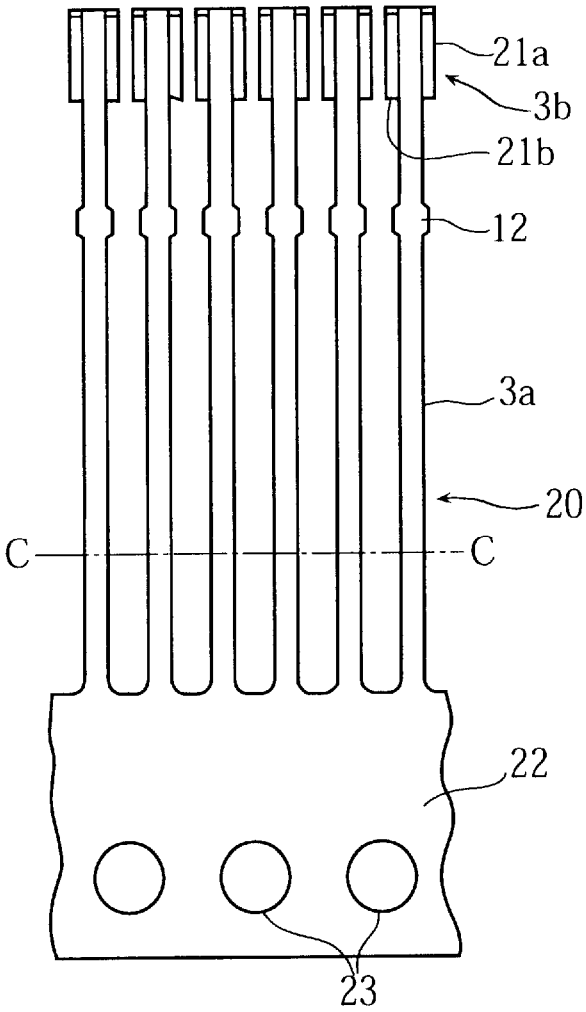
Figure 9B:
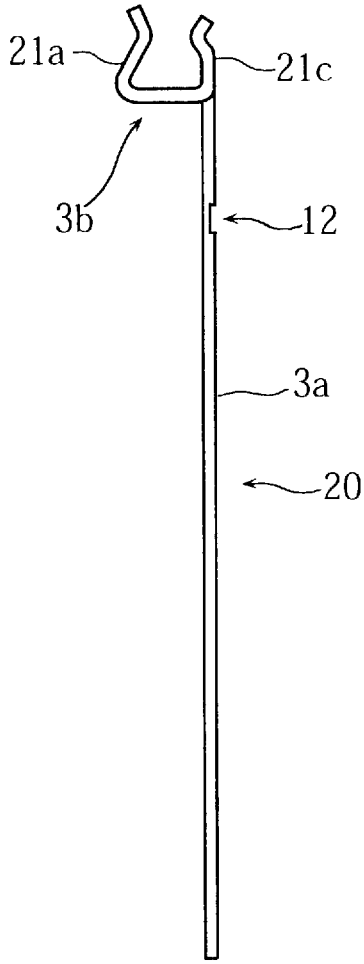

After the intermediates 20 are obtained by punching the mother plate, two parallel cuts L are made in the rectangular head portion 21 of each intermediate 20, as shown in FIG. 8. Thus, each head portion 21 is divided into a right strip 21*a*, a left strip 21*b* and a remaining part 21*c*. Then, the right and left strips 21*a*, 21*b* are bent to form an intermediate part (see 3*b*-3 in FIG. 4) and a lower holding part (see 3*b*-2 in FIG. 4). The remaining part 21*c* is bent to form an upper holding part (see 3*b*-1 in FIG. 4) whose free end has a generally V-shaped cross section. The result is shown in FIGS. 9A and 9B, wherein each intermediate 20 is provided with a clip portion 3*b* having a generally C-shaped cross section.

In the above example, the cuts L are described as being formed after the punching process with the mother plate. However, the cuts L may be formed in punching the mother plate.

After the clip portion 3*b* is formed in each intermediate 20, a suitable number of intermediates 20 are clipped onto the edge of the primary substrate in electrical connection to the relevant terminals 8. Then, the clip portions 3*b* of the respective intermediates 20 are enclosed by a resin material.

Figure 10:
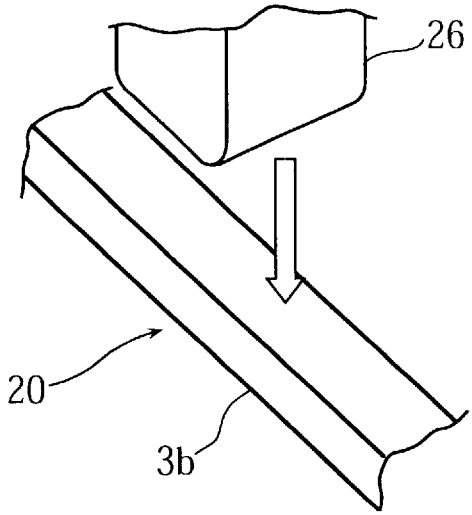

Then, a relatively thin part 12 is formed in the lead portion 3*a* of each intermediate 2. The thin part 12 may be formed by a coining technique. Specifically, referring to FIG. 10, a generally rectangular, round-cornered metal block 26 is squeezed into the lead portion 3*a* of the intermediate 20 by a predetermined depth, thereby forming a relatively large and thin part. This part may be formed either on the upper side or lower side of the lead portion 3*a*.

Finally, the intermediates 20 are cut off the tie bar 22 along a C—C line (see FIG. 9A), whereby separate clip pins 3 are obtained. As previously stated, these clip pins 3 are aligned with the terminal pads 9 on the secondary substrate 2 and then soldered to them.

Figure 11:
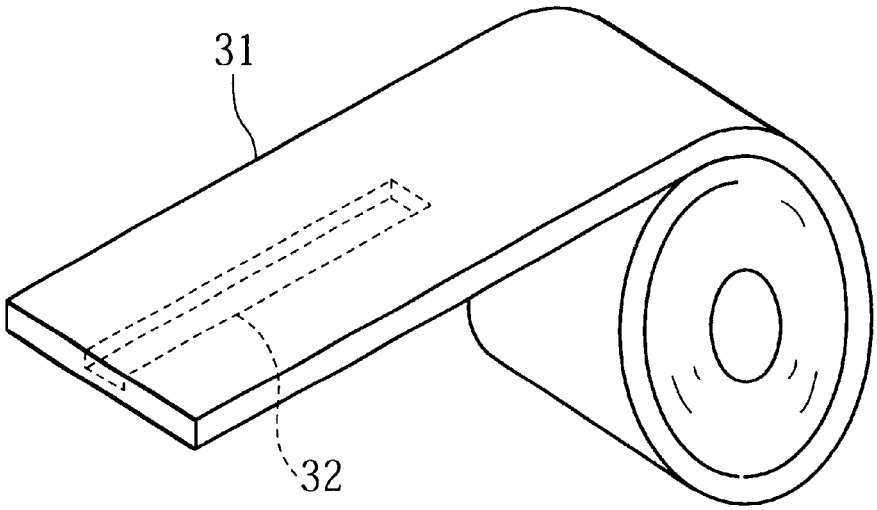
FIGS. 11 and 12 illustrate a different method of making the clip pins.
Figure 12:
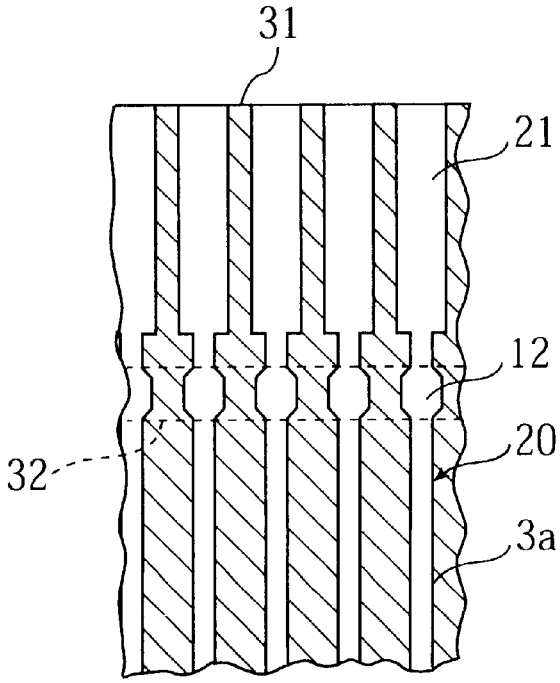
Figure 13:
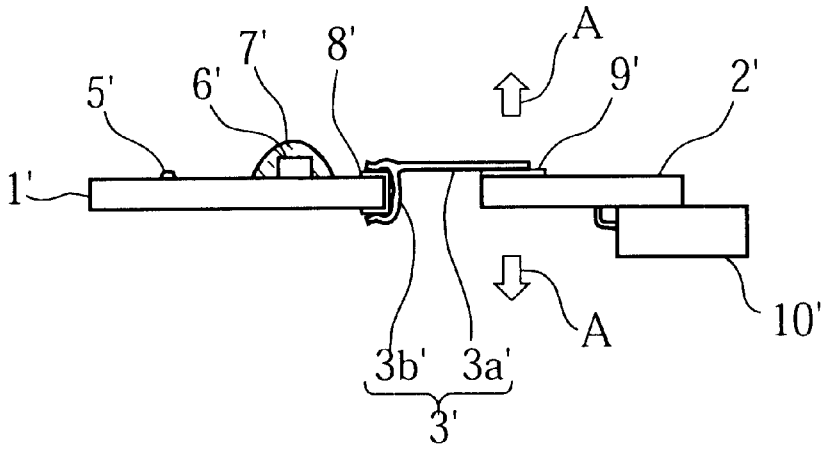
FIG.13 PRIOR ART
FIG. 13 is a side view showing a conventional thermal printhead.
Figure 14:
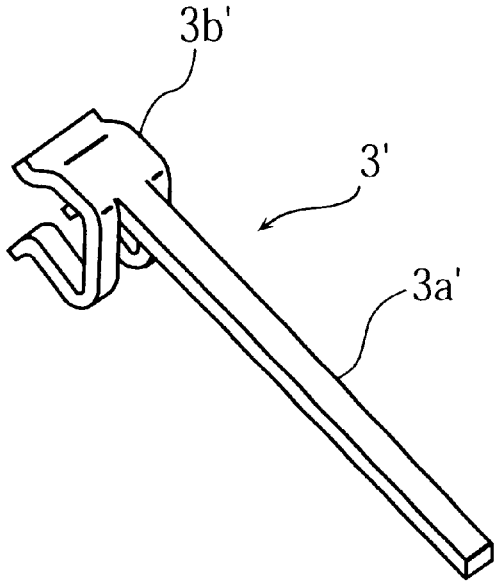
FIG.14 PRIOR ART
FIG. 14 is a perspective view showing a clip pin used for the conventional printhead.

According to the present invention, it is possible to form the relatively thin parts 12 by etching instead of coining. Specifically, referring to FIG. 11, a roll of phosphorous bronze may be prepared. Then, a suitable amount of material sheet is paid out. The paid-out portion 31 is then subjected to etching, so that a groove 32 extending longitudinally of the paid-out portion is formed. Thereafter, a predetermined part of the paid-out portion 31 is punched out. In FIG. 12, the area to be punched out is shown by hatching. As readily understood, the grooved portion will serve as the relatively thin parts 12. In the preferred embodiment described above, each clip pin 3 is provided with only one relatively thin part 12. However, two or more thin parts 12 may be formed in each clip pin 3. Of course, the present invention is applicable not only to thermal printheads but also to other electrical appliances or semiconductor devices (such as liquid crystal displays, hybrid integrated circuits, etc.) which utilize clip pins for connecting separate units.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. A thermal printhead comprising:

a first substrate provided with a heating resistor;

a second substrate spaced from the first substrate; and a plurality of connectors bridging between the first and the second substrates, each connector being provided with an elongated lead portion extending in a first direction;

wherein the lead portion is provided with a bend-facilitating part and a relatively rigid part, the bend-facilitating part having a first dimension in a second direction perpendicular to said first direction, the bend-facilitating part having a second dimension in a third direction perpendicular to said first and second directions;

wherein the bend-facilitating part is reduced in said first dimension relative to the rigid part;

wherein the bend-facilitating part is increased in said second dimension relative to the rigid part;

wherein the bend-facilitating part is generally equal in cross-sectional area to the rigid part.

2. The thermal printhead according to claim 1, wherein the bend-facilitating parts of the respective connectors are arranged in a single line.

3. The thermal printhead according to claim 1, wherein the bend-facilitating part of each connector positionally differs in said first direction from the bend-facilitating part of a next connector.

4. The thermal printhead according to claim 1, wherein the bend-facilitating parts of the respective connectors are disposed between the first and the second substrates.

5. The thermal printhead according to claim 1, wherein each connector is provided with a clip portion formed integral with the lead portion.

6. A clip pin for connecting separate electrical units comprising:

a generally straight lead portion extending in a first direction; and a clip portion formed at an end of the lead portion;

wherein the lead portion is provided with a bend-facilitating part which has a first dimension in a second direction perpendicular to said first direction, the bend-facilitating part having a second dimension in a third direction perpendicular to said first and second directions;

wherein the bend-facilitating part is reduced in said first dimension relative to a remaining part of the lead portion;

wherein the bend-facilitating part is increased in said second dimension relative to the remaining part of the lead portion;

wherein the bend-facilitating part is generally equal in cross-sectional area to the remaining part of the lead portion.

7. The clip pin according to claim 6, wherein the clip portion includes an upper holding part and a lower holding part spaced vertically from the upper holding part, the bend-facilitating part having a principal surface whose normal extends generally vertically.

* * * * *